US006135901A

United States Patent [19]

van Nimwegen

[11] Patent Number: 6,135,901

[45] Date of Patent: *Oct. 24, 2000

[54] COMPRESSION CRANK ADJUSTMENT MECHANISM FOR A BASKETBALL GOAL ASSEMBLY

[75] Inventor: Edward G. van Nimwegen, North Ogden, Utah

[73] Assignee: Lifetime Products, Inc., Clearfield, Utah

[ * ] Notice: This patent is subject to a terminal disclaimer.

[21] Appl. No.: 09/249,278

[22] Filed: Feb. 11, 1999

Related U.S. Application Data

[63] Continuation-in-part of application No. 09/018,231, Feb. 3, 1998, which is a continuation-in-part of application No. 08/986,382, Dec. 8, 1997, Pat. No. 5,879,247, which is a continuation-in-part of application No. 08/799,979, Feb. 12, 1997, Pat. No. 5,695,417.

[51] Int. Cl.[7] ..... A63B 63/08

[52] U.S. Cl. ..... 473/484; 473/483; 473/482; 473/481; 248/283.1; 248/280.11

[58] Field of Search ..... 473/471, 481, 473/482, 483, 484; 248/283.1, 404, 280.11, 161, 162.1

[56] References Cited

U.S. PATENT DOCUMENTS

| | | |
|---|---|---|
| 276,637 | 5/1883 | Slater . |
| D. 350,797 | 9/1994 | Curtis . |
| 1,924,811 | 8/1933 | Schulz . |
| 2,932,511 | 4/1960 | Bemis . |
| 3,427,025 | 2/1969 | Procter . |
| 3,586,324 | 6/1971 | Bearson . |
| 3,765,676 | 10/1973 | Bearson et al. . |
| 3,802,702 | 4/1974 | Pulley . |
| 4,395,040 | 7/1983 | White . |
| 4,438,923 | 3/1984 | Engle et al. . |
| 4,441,709 | 4/1984 | Schroeder et al. . |

(List continued on next page.)

FOREIGN PATENT DOCUMENTS 28616 5/1965 Netherlands .

OTHER PUBLICATIONS

Harvard, "1988 Sporting Goods Catalog," p. 8.

Diversified Products, "DP Fit for Life," 1990 Equipment Catalog, Opelika, Alabama, p. 61.

Bison, "An American Legacy", Bison Recreational Products 1993–1994 Catalog.

"Component Play Grounds," Equipment Brochure, Salt Lake City, Utah, p. 6 (date unknown).

BPI, "BPI Portable Systems", Basketball Products International Catalog (date unknown).

BPI, "At the Heart of the Sport", Basketball Products International Catalog (date unknown).

(List continued on next page.)

*Primary Examiner*—Raleigh W. Chiu

*Attorney, Agent, or Firm*—Madson & Metcalf

[57] ABSTRACT

A novel compression crank adjustment mechanism for a basketball goal assembly is disclosed in one presently preferred embodiment which facilitates an adjustment in the height of a basketball goal above a playing surface. The basketball goal assembly includes a deformable goal support structure attached at a first end to a rigid support pole. A basketball goal is preferably attached at a second opposing end of the goal support structure. An extension arm is operably connected between the goal support structure and a first adjustment member positioned along the back side of the support pole. A second adjustment member is connected to the support pole and configured for threaded engagement with the first adjustment member. The first and second adjustment members are operably disposed in compression relative to each other under the force acting on the basketball goal assembly. A rotatable handle is attached to the first adjustment member to facilitate movement of the first adjustment member relative to the second adjustment member, thereby selectively positioning the goal support structure into a plurality of configurations in relation to the playing surface.

18 Claims, 3 Drawing Sheets

U.S. PATENT DOCUMENTS

| | | |
|---|---|---|
| 4,465,277 | 8/1984 | Dittrich . |
| 4,684,129 | 8/1987 | Andersen et al. . |
| 4,781,375 | 11/1988 | Nye . |
| 4,798,381 | 1/1989 | Dadbeh . |
| 4,801,142 | 1/1989 | Friesen . |
| 4,805,904 | 2/1989 | Nye . |
| 4,846,469 | 7/1989 | Nye . |
| 4,881,734 | 11/1989 | Nye . |
| 5,133,547 | 7/1992 | Pardi . |
| 5,158,281 | 10/1992 | Williams . |
| 5,211,393 | 5/1993 | Rolffs et al. . |
| 5,259,612 | 11/1993 | Matherne et al. . |
| 5,388,821 | 2/1995 | Blackburn . |
| 5,465,957 | 11/1995 | Schroeder . |
| 5,478,068 | 12/1995 | Schroeder . |
| 5,503,390 | 4/1996 | Hall . |
| 5,573,237 | 11/1996 | Van Nimwegen et al. . |
| 5,573,238 | 11/1996 | Aaron et al. . |
| 5,601,284 | 2/1997 | Blackwell et al. . |
| 5,695,417 | 12/1997 | Winter et al. . |
| 5,720,679 | 2/1998 | Schroeder . |
| 5,738,601 | 4/1998 | Hughes . |
| 5,879,247 | 3/1999 | Winter et al. . |

OTHER PUBLICATIONS

Diversified Products, "25 Years of Innovation," Opelika, Alabama, p. 69 (date unknown).

Escalade Sports, "Serious Play", 1997 Products Catalog featuring Harvard, Stiga, and Spalding Poducts.

Goalrilla Basketball Systems, "A–LIN Series", Product Brochure (date unknown).

HHBS, Inc., "Pro Series", Basketball Systems Brochure (date unknown).

Huffy Sports, "Be A Player", Client assembled folder of fact sheets (date unknown).

Huffy Sports, "Introducing New Huffy Elevator," Informational Brochure, Waukesha, Wisconsin (date unknown).

Huffy Sports, "Basketball's Hottest Products this year," Equipment Catalog, Waukesha, Wisconsin (date unknown).

Huffy Sports, Equipment Catalog, Waukesha, Wisconsin, p. 21 (date unknown).

Huffy Sports, "Our All–Star Lineup," Waukesha, Wisconsin, p. 21 (date unknown).

Huffy Sports, Equipment Assembly Instruction Sheet, Waukesha, Wisconsin (date unknown).

Porter, "All–in–One "Quick Adjust" Kits," Informational Brochure (date unknown).

Rolbak, "The Original Basket Ball Protecto Net" Fact Sheet (date unknown).

Spalding, "Movers Don't Have to be Shakers", Pro System Mobile Brochure (date unknown).

Sport Court, "Slam Systems", Basketball Standards Catalog (date unknown).

Sure Shot, "Your Best Shot", Product Catalog (date unknown).

Ultra Rim Adjustable Basketball Goals, "The Ultimate Goal", Two–Fold Brochure (date unknown).

Wilson, "Adjustable Backstop Support, Backboard and Goal Kit," Informational Brochure, Franklin Park, Illinois (date unknown).

COMPRESSION CRANK ADJUSTMENT MECHANISM FOR A BASKETBALL GOAL ASSEMBLY

RELATED U.S. APPLICATIONS

This application is a continuation-in-part of our co-pending patent application Ser. No. 09/018,231, filed Feb. 3, 1998 and entitled ADJUSTABLE BASKETBALL GOAL SYSTEM, which is a continuation-in-part of application Ser. No. 08/986,382 filed Dec. 8, 1997 and entitled POWER LIFT BASKETBALL ADJUSTMENT SYSTEM, now U.S. Pat. No. 5,879,247 which is a continuation of application Ser. No. 08/799,979 filed Feb. 12, 1997 and entitled POWER LIFT BASKETBALL ADJUSTMENT SYSTEM, now issued as U.S. Pat. No. 5,695,417. The foregoing applications are incorporated herein by reference.

BACKGROUND OF THE INVENTION

1. The Field of the Invention

The present invention is related to an apparatus for adjusting the height of a basketball goal and, more particularly, to a novel compression crank adjustment mechanism for a basketball goal assembly having an extension arm adjustable between a plurality of positions to facilitate the adjustment of the basketball goal over a playing surface.

2. Technical Background

Basketball is an increasingly popular sport in the United States and abroad. There are many cities, counties and other associations that sponsor recreational and instruction leagues where people of all ages can participate in the sport of basketball. Today there are organized leagues for children as young as five and six years old. Accordingly, is not surprising that more and more people have a basketball goal assembly mounted on their own property.

The problem with many basketball goal assemblies of the prior art is that the goal is usually fixed at a certain height above the playing surface, with a standard height being about ten (10) feet. Children and younger teens, however, generally don't have the strength or agility to shoot and make a basket at the typical height often feet. Moreover, children tend to develop improper shooting skills by attempting to throw a basketball toward a goal that is disposed too high. Oftentimes, children or younger teens get frustrated with the sport of basketball and may give up the sport altogether.

Many attempts have been made by those skilled in the art to design basketball goal assemblies which are adjustable to several different heights. Adjustable basketball goal assemblies allow persons of all ages and sizes to enjoy the sport of basketball because the basketball goal can be adjusted to various heights above the playing surface. Some prior art basketball goal assemblies employ a deformable linkage design which generally connects the backboard to a rigid mount such as a support pole. In operation, prior art deformable linkages may be selectively locked at various positions to secure the basketball goal at a predetermined height above the playing surface.

One disadvantage of prior art deformable linkage devices is that the adjustment mechanism is typically positioned within or near the linkage which is generally well above the playing surface. Accordingly, whenever a user desires to adjust the height of the basketball goal, the use of a ladder, stool or the like is required to enable the user to reach the adjustment mechanism and "unlock" the basketball goal.

Having to use a ladder, stool or the like to adjust the height of the basketball goal creates an inherent danger to the user of the potential for falling.

Other prior art adjustable basketball goal assemblies were developed having an adjustment mechanism that is only accessible with the use of a separate rod or pole, such as a broomstick handle. Often times, there is not such an adjustment device readily available. The user must therefore accommodate the inconvenience of having to find a suitable implement, or simply choose not to adjust the height of the basketball goal.

Another disadvantage of many prior art adjustable basketball goal assemblies is that the mechanism for adjusting the height of the basketball goal is separate and distinct from the mechanism used to secure the goal assembly at a particular height. Thus, both hands of a user are normally needed to simultaneously unlock the adjustment mechanism, adjust the basketball goal and then lock the adjustment mechanism at a predetermined position.

Some prior art basketball goal assemblies are configured with the adjustment mechanism positioned adjacent the basketball playing area. Such adjustment mechanisms can interfere with users, thereby creating a potentially dangerous situation. For example, such adjustable basketball goal assemblies are usually subject to inadvertent adjustment if bumped by a user or hit with a basketball.

Yet another disadvantage of prior art basketball goal assemblies is that the adjustment mechanism is in tension with the linkage device attached to the goal, thus the locking or adjustment mechanism is susceptible to separation upon failure and, accordingly, the goal assembly may drop into the playing area and cause potential injuries to uses. Another disadvantage of prior art basketball goal adjustment assemblies is that many of the securing and adjustment mechanisms require numerous working components and a complex design configuration to be able to simultaneously adjust and secure the basketball goal assembly in a predetermined position above a playing surface. This increases the cost, the difficulty of manufacture and the time necessary to assembly the basketball goal assembly by a user.

From the foregoing, it will be appreciated that it would be an advancement in the art to provide an adjustable basketball goal assembly that can be adjusted without the use of a ladder or a pole. It would be a further advancement to provide such an adjustable basketball goal assembly that could be quickly and easily adjusted using a single hand of a user. It would be yet another advancement to provide an adjustable basketball goal assembly that does not interfere with game play and that would not endanger users if the adjustment or locking mechanism failed. Finally, it would be another advancement in the art to provide an adjustable basketball goal assembly that is simple in design and cost effective relative to manufacture.

Such an adjustable basketball goal assembly is disclosed and claimed herein.

BRIEF SUMMARY OF THE INVENTION

The present invention is directed to a novel adjustable basketball goal assembly having a compression crank mechanism that facilitates adjusting the height of a basketball goal above a playing surface. The basketball goal assembly of the present invention includes a rigid support that extends in a substantially upward direction. The rigid support has a goal side and a back side formed opposite the goal side. A deformable goal support structure may be pivotally attached to the goal side of the rigid support such that the goal support structure is suspended above the playing surface. The goal support structure includes an upper support arm and a lower support arm. In one presently preferred embodiment of the present invention, one of the support arms has a tail section which extends substantially outward from the back side of the rigid support pole.

A basketball goal is preferably attached to the goal support structure adjacent the goal side of the rigid support. In one presently preferred embodiment, the goal consists of a rim, a backboard and a net. The goal support structure is preferably configured such that as the goal support structure deforms, the height of the basketball goal above the playing surface is correspondingly adjusted, wherein each variation in height of the basketball goal corresponds to a different deformation of the goal support structure. In operation, the goal support structure allows the rim of the basketball goal to be adjusted to several different heights while retaining the rim in a substantially horizontal disposition in relation to the playing surface.

In one presently preferred embodiment, an adjustment crank is pivotally mounted at the back side of the rigid support pole such that a user can adjust the crank without needing a ladder, stool, pole or the like. An extension arm is preferably positioned between the parallelogrammic deformable goal support structure and the adjustment crank substantially along the back side of the rigid support. A first end of the extension arm is pivotally attached to the tail section of the lower support arm and a second opposing end of the extension arm is pivotally attached to the adjustment crank. The extension arm may include a stabilizing arm having a first end pivotally attached to the support pole and a second end pivotally attached contiguous a second end of the extension arm. In this configuration, an adjustment of the crank moves the extension arm and deforms the parallelogrammic structure to thereby adjust the height of the basketball goal in relation to the playing surface. Thus, the height of the basketball goal can be adjusted without the use of a ladder or other adjustment implement.

In preferred design, the adjustment crank includes a first adjustment member connected to the extension arm at a first point of attachment and a second adjustment member connected to the rigid support at a second point of attachment disposed above the first point of attachment. Thus, the adjustment crank is in compression under the force of the basketball goal assembly. The first and second adjustment members may be threaded for cooperative engagement with each other. In this regard, the threads are generally configured to provide maximum mechanical advantage and thereby facilitate easy adjustment of the basketball goal assembly.

In one presently preferred embodiment, a crank handle is attached to the first adjustment member to facilitate the selective movement of the first adjustment member relative to the second adjustment member. This configuration permits selective movement of the first adjustment member relative to said second adjustment member which in turn deforms the goal support structure and repositions the height of the basketball goal above the playing surface.

The basketball goal assembly may also include a support base configured having an internal cavity sufficient for receiving and retaining a ballast material. The support base is configured such that when filled with a ballast material, the base stabilizes the adjustable basketball goal assembly and supports the support pole, disposed in a receiving aperture formed in the support base, in a substantially upright position.

Thus, it is an advantage of the present invention to provide an adjustable basketball goal assembly with an adjustment mechanism in compression with the extension arm and which does not interfere with the playing area. It is another advantage of the present invention to be able to adjust the height of the basketball goal without the aid of a ladder or pole. It is a further advantage of the present invention to be able to easily adjust the height of the basketball goal using only a single hand of a user. It is another advantage of the present invention to provide a compression crank adjustment mechanism for an adjustable basketball goal assembly that is cost effective to manufacture and easy to assemble.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 2:
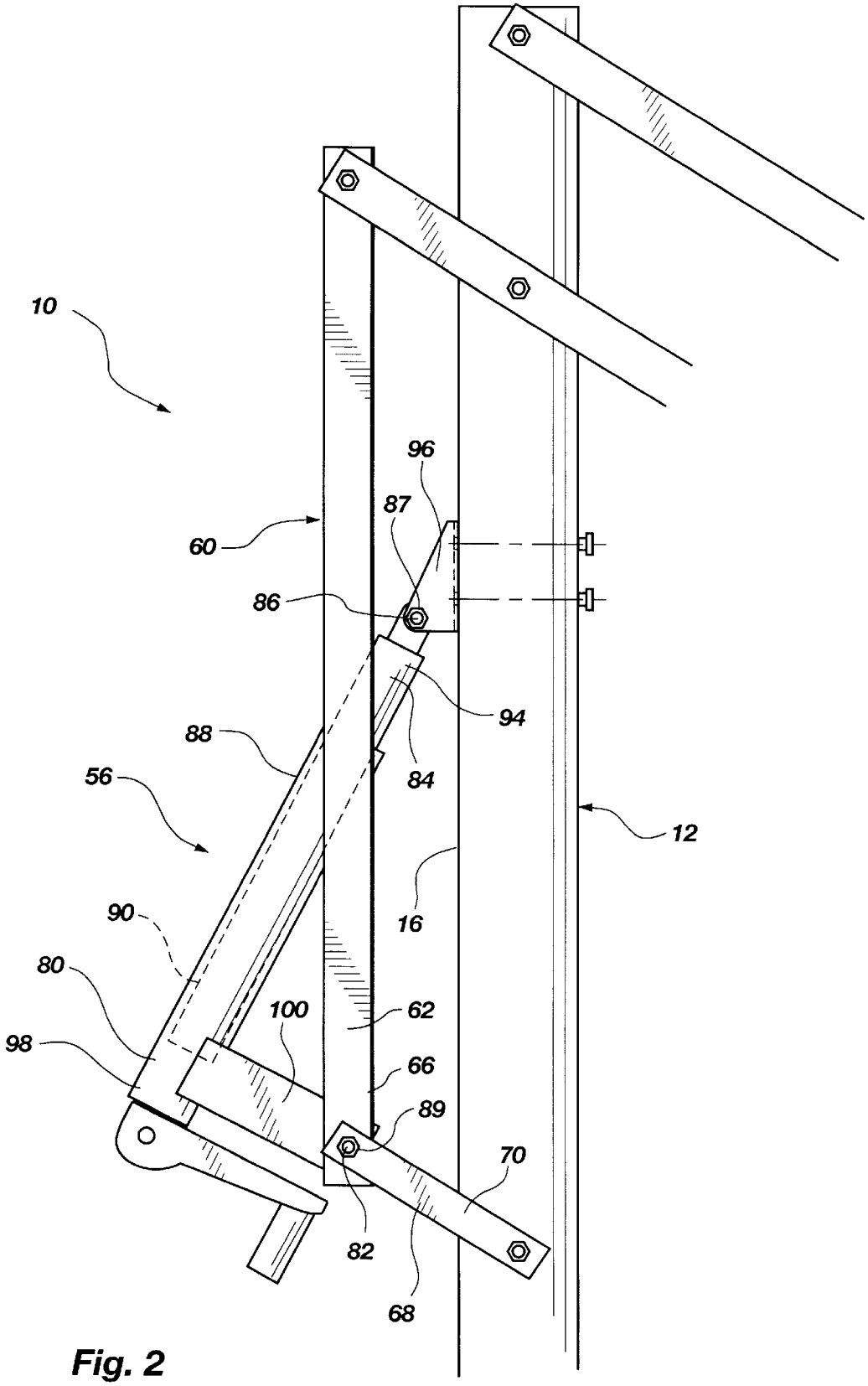
FIG. 2 is a side plan view of the compression crank adjustment mechanism of the basketball goal assembly of FIG. 1.
Figure 3:
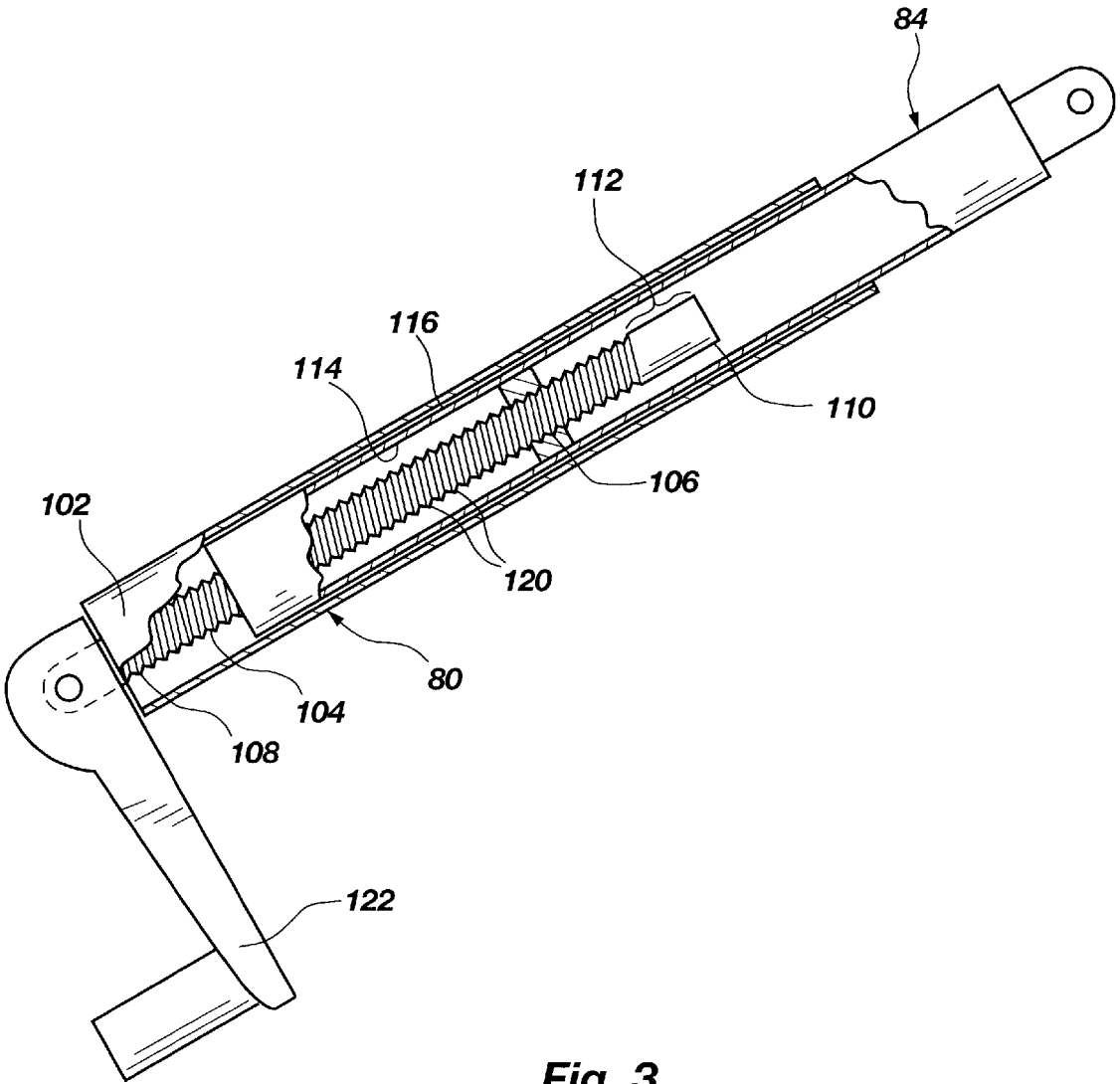
FIG. 3 is a partial cut-away, side cross-sectional view of the compression crank adjustment mechanism of the basketball goal assembly of FIG. 1.

It will be readily understood that the components of the present invention, as generally described and illustrated in the Figures herein, could be arranged and designed in a wide variety of different configurations. Thus, the following more detailed description of the embodiments of the assembly and method of the present invention, as represented in FIGS. 1 through 3, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
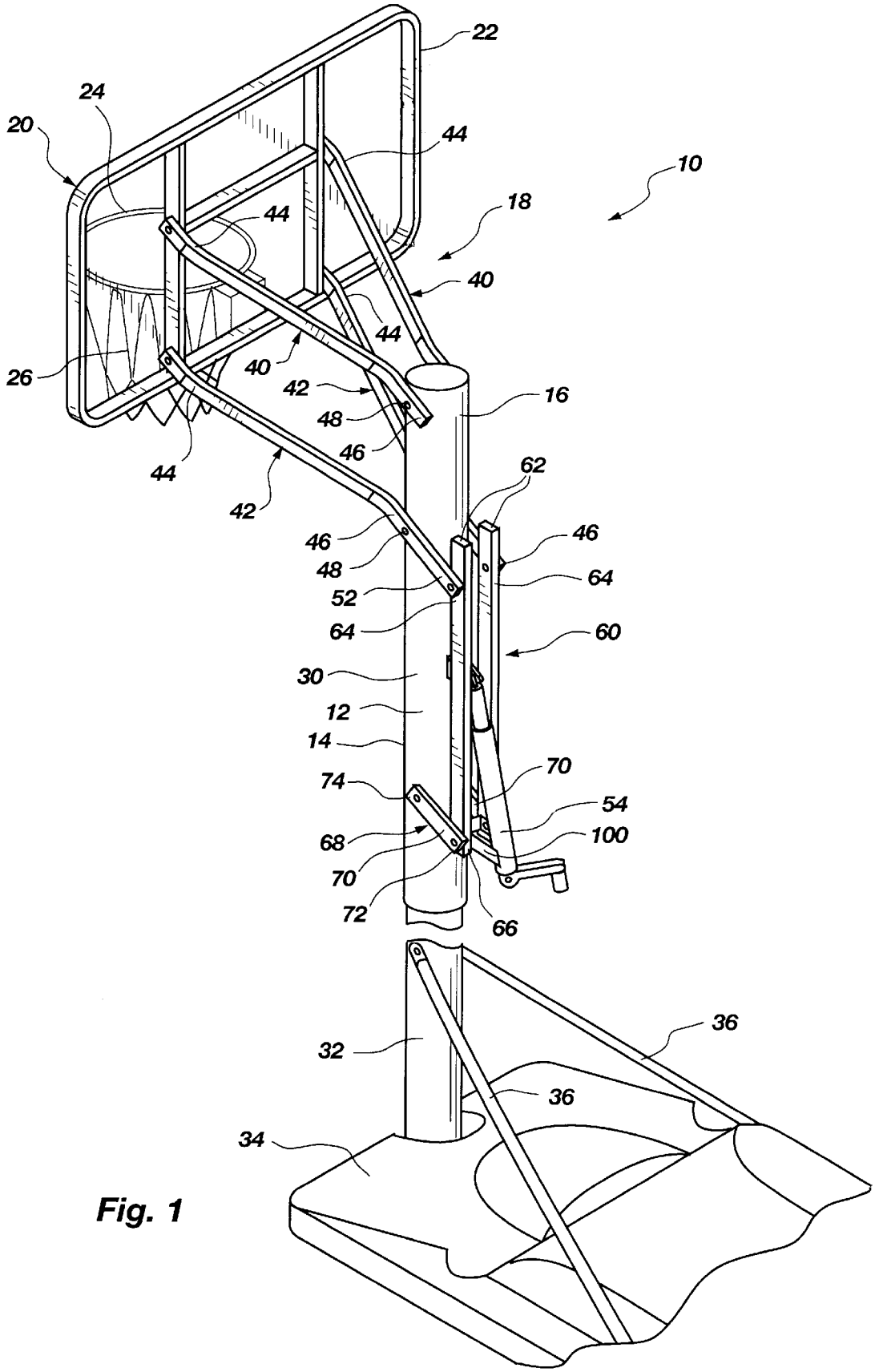
FIG. 1 is a perspective view of one presently preferred embodiment of a compression crank adjustment mechanism for a basketball goal assembly of the present invention.

With reference now to FIG. 1, one presently preferred embodiment of the compression crank adjustment mechanism of the basketball goal assembly according to the present invention is generally designated at 10. As shown, the basketball goal assembly 10 includes a rigid support pole 12 having a goal side 14 and a back side 16 disposed opposite the goal side. The support pole 12 generally extends in a substantially upward direction when the basketball goal assembly 10 is disposed in the playing position.

A goal support structure 18 is disposed in relation to the rigid support pole 12 adjacent a goal side 14 of the rigid support 12 above the playing surface. A basketball goal 20 including a back board 22, a rim 24 and a net 26 may be attached to the goal support structure 18 opposite the support pole 12. The goal support structure 18 may be deformable into a plurality of configurations wherein at each configuration the basketball goal 20 is disposed at a different height above the playing surface.

In one presently preferred embodiment, the support pole 12 includes an upper pole section 30, to which the goal support structure 18 is attached, and a lower pole section 32 introduceable (e.g., press fit) into the upper pole section 30. This configuration allows the adjustable basketball goal assembly 10 easier and more cost effective to package.

As shown, the lower pole section 32 may be attached to a portable support base 34 having an internal cavity for introducing and selectively retaining a ballast material. Functionally, the support base 34 supports and stabilizes the support pole 12 and the goal support structure 18 in relation to the playing surface. A pair of rods 36 may be provided to secure the rigid support 12 to the support base 34. As will be appreciated by those of skill in the art, there are a variety of ways readily known in the art to configure a support base 34 in such a manner to stabilize and secure a rigid support pole 12 in a generally upright position. It will further be appreciated that the teachings of this invention may be practiced using a permanent mount in place of the support base 34 and thereby secure the rigid support 12 directly to the floor or ground at a specific location.

The goal support structure 18 of the adjustable basketball goal assembly 10 may comprise a pair of upper support arms 40 and lower support arms 42. The upper and lower support arms 40, 42 each have a first end 44 and a second end 46, respectively. In one presently preferred embodiment, the first ends 44 of the upper and lower support arms 40, 42 are pivotally attached to the basketball goal 20 at differing locations. Preferably, the upper and lower support arms 40, 42 are each pivotally attached to the rigid support 12 adjacent the second ends 46 of the upper and lower support arms 40, 42 with a fastener 48 (e.g., bolts, screws, rivets or the like) introduced through corresponding openings (not shown) formed within the upper and lower support arms 40, 42 and the rigid support pole 12. The upper and lower support arms 40, 42 are likewise pivotally attached to the basketball goal support 20 by fasteners 48 (e.g., bolts, screws, rivets or the like) positioned through aligned openings (not shown). As will be appreciated, there are a variety of other suitable fixation members or methods readily known in the art to pivotally attach the basketball goal to the rigid support pole 12.

As best shown in FIG. 1, the upper supports 40, the lower supports 42, the support pole 12, and the backboard 22 define a goal support structure 18, which is preferably parallelogrammic in configuration. Because the upper supports 40 and the lower supports 42 are pivotally mounted, the parallelogrammic goal support structure 18 can be deformed to adjust the height of the basketball goal 18 above a playing surface while allowing the backboard 22 to remain substantially vertical in disposition and the rim 24 to remain substantially horizontal in relative disposition.

At least one of the support arms 40, 42 includes a tail section 52 adjacent the second end 46 of the support arms 40, 42 which extends substantially outwardly from the back side 16 of the rigid support 12. In one presently preferred embodiment, the tail section 52 is an integral part of the lower support arms 42. Structurally, the tail section 52 provides a place to link the goal support structure 18 to an adjustment mechanism 54 which is preferably pivotally mounted adjacent the back side 16 of the rigid support 12 such that a user can manipulate the adjustment mechanism 54 while standing on the ground.

Consistent with the foregoing structural configuration, the height of the basketball goal 20 may be adjusted without the aid of a separate adjustment device, ladder, stool or the like. Further, with the adjustment mechanism 54 located on the back side 16 of the rigid support 12, the adjustment mechanism 54 is less likely to interfere with basketball play. In one presently preferred embodiment, the adjustment mechanism 56 comprises an adjustment crank 56.

Referring now to FIGS. 1 and 2, an extension arm 60 includes at least one bar 62. In one presently preferred embodiment, the extension arm 60 includes a pair of bars 62, each having a first end 64 and a second end 66. The first end 64 of each of the bars 62 may be pivotally attached to the respective tail sections 52 of the lower support arms 42. The second end 66 of each of the bars 62 may be disposed for cooperation with the adjustment crank 56, discussed in more detail herein below. The extension arm 60 may include a stabilizer arm 68 that is pivotally attached to the support pole 12. In one presently preferred embodiment, the stabilizer arm 68 includes a pair of tie bars 70 pivotally connected at a first end 72 to the bars 62 and at a second end 74 to the rigid support 12. The extension arm 60 is positioned substantially along the back side 16 of the rigid support 12 such that movement of the extension arm 60 selectively deforms the goal support structure 20. The extension arm 60 may be pivotally attached to the tail section 52 and support pole 12 by a variety of ways known in the art, including bolts, screws, rivets, cotter pins or the like.

As best shown in FIG. 2, the adjustment crank 56 includes a first adjustment member 80 pivotally connected to the extension arm 60 at a first point of attachment 82. The adjustment crank also includes a second adjustment member 84 pivotally connected to the support pole 12 at a second point of attachment 86. A first end 88 of the first adjustment member 80 is configured to cooperate with a first end 90 of the second adjustment member 84 to thereby permit selective movement of the first adjustment member 80 relative to the second adjustment member 84.

In one presently preferred embodiment, the adjustment crank 56 is positioned relative to the rigid support 12 and extension arm 60 such that the second point of attachment 86 is disposed above the first point of attachment 82. One of skill in the art will appreciate that in this configuration, the force due to gravity acting on the basketball goal 20 and transferred to the extension arm 60 will cause the first adjustment member 80 and the second adjustment member 84 to be in compression relative to each other. With the first adjustment member 80 and the second adjustment member 84 in compressive engagement relative to each other, failure of the adjustment mechanism 54 will not result in the first adjustment member 80 and the second adjustment member 84 becoming disengaged from each other, which may result in the basketball goal 20 pivoting downward into the playing area. Accordingly, the compressive engagement of the first adjustment member 80 and the second adjustment member 84 along the back side 16 of the support pole 12 provides a measure of security to the adjustable basketball goal assembly 10.

In one presently preferred embodiment, the second adjustment member 84 is attached at a second end 94 to the support pole 12 by means of a fastener 96 (e.g., bolt, screw, rivet or the like) secured to the back side 16 of the support pole 12. For example, a bolt 87 may be positioned within aligned openings within the second end 94 of the second adjustment member 84 and within a bracket 96 to secure the second adjustment member 84 to the rigid support 12.

The first adjustment member 80 preferably includes a U-shaped bracket 100 welded to a second end 98 of the first adjustment member 80. The U-shaped bracket 100 is configured with a pair of holes (not shown) such that a fastener 89 (e.g., bolt, screw, rivet or the like) may be positioned through the U-shaped bracket 100 and corresponding holes (not shown) through the second end 66 of each bar 62. In one presently preferred embodiment, the fastener 89 is also positioned within holes (not shown) in the first ends 72 of the tie bars 70, such that the adjustment crank 56, extension arm 60 and stabilizer arm 68 are all connected at the first point of attachment 82. It will be readily appreciated by those skilled in the art that the adjustment mechanism 54 may be positioned in a variety of ways relative to the extension arm 60 and the support pole 12 to allow the adjustment mechanism 54 to remain in compression, rather than in tension along the back side 16 of the support pole 12.

Referring now to FIG. 3, the first adjustment member 80 includes an outer shell 102 and a threaded portion 104 configured for rotatable engagement with a threaded portion 106 of the second adjustment member 84. In one presently preferred embodiment, the first adjustment member 80 comprises a substantially threaded rod 104 positioned within the substantially hollow outer shell 102. The rod 104 is rotatably attached to the outer shell at a first end 108 of the rod 104. A second end 110 of the rod 104 includes a portion 112 that is not threaded. In one presently preferred embodiment, the outer shell 102 of the first adjustment member 80 is substantially cylindrical in shape. Although the adjustment member 80 is illustrated and described in connection with a generally cylindrical configuration, those skilled in the art will recognize that various other geometrical configurations are likewise suitable. The use of a generally cylindrical configuration is thus by way of illustration only and not by way of limitation.

The second adjustment member 84 is substantially hollow having an inner surface 114 and outer surface 116. Preferably, the outer surface 116 is configured to fit within and closely engage the outer shell 102 of the first adjustment member 80 in telescopic engagement. The threaded portion 106 of the second adjustment member 84 comprises a threaded engagement member 106 (e.g., a nut or the like) affixed to the inner surface 114 for threaded engagement with the threaded rod 104. Thus, rotation of the rod 104 relative to the engaging member 106 causes the first adjustment member 80 to move telescopically relative to the second adjustment member 84. When the engaging member 106 is positioned about the unthreaded portion 112, there is no threaded engagement between the first adjustment member 80 and the second adjustment member 84.

As will be appreciated by those skilled in the art, further rotation of the threaded rod 104 at this point will no longer cause the first adjustment member 80 to move relative to the second adjustment member 84. Thus, the engaging member 106 can be positioned to limit adjustment of the height of the basketball goal in one direction. In operation, travel of the engaging member 106 along the threaded rod 104 is limited in the opposite direction when the second adjustment member 84 abuts the first adjustment member 80 at the first end 108 of the rod 106. It will be appreciated by those of skill in the art that the threads 120 on the threaded rod 104 are close enough in distance and comprise a narrow enough pitch to provide the maximum mechanical advantage when turning the rod, thereby facilitating easy turning of the adjustment crank 56.

A variety of threaded members in various combinations may be used to practice the teachings of the present invention such as, for example, a worm gear or drive or a combination of various sized gears positioned for engagement with each other or an adjustment member. Alternatively, a gear in combination with a slotted member may be used such that as the gear turns, the slotted member moves relative to the gear. The slotted member may include the extension arm 60 or either of the adjustment members 80, 84.

As best shown in FIGS. 2 and 3, the adjustment crank 56 also includes a crank handle 122 mechanically attached to the first adjustment member 80 to thereby facilitate selective movement of the first adjustment member 80 relative to the second adjustment member 84. In one presently preferred embodiment, the crank handle 122 is pivotally attached to the rod 104 of the first adjustment member 80 with a cotter pin. As will be appreciated by those skilled in the art, the handle 122 may be attached to the first adjustment member 80 in any number of ways known in the art. For example, one such way may include making the handle 122 an integral part of the rod 104.

With reference back to FIGS. 1 and 2, the height of the basketball goal 20 may be adjusted by engaging the crank handle 122 and rotating it in one direction such that the first and second adjustment members 80, 84 compress relative to each other thereby raising the extension arm 60 and lowering the basketball goal 20 in relation to the playing surface. Alternatively, rotating the crank handle 122 in an opposite direction raises the basketball goal 20 in relation to the playing surface.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated in the appended claims rather than by the foregoing description. All changes within the meaning and range of the claims are to be embraced within their scope.

What is claimed and desired to be secured by United States Letters Patent is:

1. A basketball goal assembly allowing for adjustment of the height of a basketball goal above a playing surface, said basketball goal assembly comprising:

a rigid support pole;

a goal support structure disposed in relation to said support pole, said goal support structure being deformable into a plurality of configurations wherein at each configuration said basketball goal is disposed at a different height above said playing surface;

an extension arm having a first end connected to said goal support structure and a second end connected to said support pole such that movement of said extension arm selectively deforms the goal support structure;

an adjustable compression mechanism comprising a first adjustment member connected to said extension arm and a second adjustment member connected to said support pole, said first adjustment member operably disposed relative to said second adjustment member in a compressive engagement, thereby permitting movement of the first adjustment member relative to the second adjustment member to selectively dispose said goal support structure into said plurality of configurations in relation to said playing surface; and wherein said first adjustment member comprises a threaded portion configured for threaded engagement with said second adjustment member.

2. A basketball goal assembly as defined in claim 1, wherein said deformable goal structure is substantially parallelogrammic in configuration.

3. A basketball goal assembly as defined in claim 1, wherein said extension arm is adapted to engage a stabilizing arm having a first end pivotally attached to said support pole and a second end pivotally attached to said extension arm.

4. A basketball goal assembly as defined in claim 1, wherein said extension arm is operably disposed contiguous a back side of said rigid support.

5. A basketball goal assembly as defined in claim 1, wherein said connection of said first adjustment member of said adjustable compression mechanism is disposed below said connection of said second adjustment member.

6. A basketball goal assembly as defined in claim 1, further comprising a handle operably attached to said first adjustment member to facilitate movement of the first adjustment member relative to said second adjustment member.

7. A basketball goal assembly as defined in claim 1, further comprising a support base having a receiving aperture sufficient for receiving and retaining said support pole in a substantially upright position in relation to said playing surface.

8. A basketball goal assembly as defined in claim 7, wherein said support base comprises an internal cavity sufficient for receiving and selectively retaining a ballast material.

9. A basketball goal assembly allowing for adjustment of the height of a basketball goal above a playing surface, said basketball goal assembly comprising:

a rigid support pole having a goal side and an opposing back side;

a goal support structure disposed in relation to said support pole at said goal side, said goal support structure being deformable into a plurality of configurations wherein at each configuration said basketball goal is disposed at a different height above said playing surface;

an extension arm having a first end connected to said goal support structure and a second end connected to said back side of said support pole such that movement of said extension arm selectively deforms the goal support structure;

an adjustable compression mechanism comprising a first adjustment member connected to said extension arm at a first point of attachment and a second adjustment member connected to said support pole at a second point of attachment, said second point of attachment positionable above said first point of attachment, wherein said second adjustment member is configured to cooperate with said first adjustment member thereby permitting movement of the first adjustment member relative to said second adjustment member to selectively dispose said goal support structure into said plurality of configurations in relation to said playing surface; and wherein said first adjustment member comprises a threaded portion configured for threaded engagement with said second adjustment member.

10. A basketball goal assembly as defined in claim 5, wherein said deformable goal structure is substantially parallelogrammic in configuration.

11. A basketball goal assembly as defined in claim 5, wherein said extension arm is adapted to engage a stabilizing arm having a first end pivotally attached to said support pole and a second end pivotally attached to said extension arm.

12. A basketball goal assembly as defined in claim 5, further comprising a handle operably attached to said first adjustment member to facilitate movement of the first adjustment member relative to said second adjustment member.

13. A basketball goal assembly as defined in claim 5, further comprising a support base having a receiving aperture for receiving and retaining said support pole in a substantially upright position in relation to said playing surface.

14. A basketball goal assembly as defined in claim 13, wherein said support base comprises an internal cavity sufficient for receiving and selectively retaining a ballast material.

15. A basketball goal assembly allowing for adjustment of the height of a basketball goal above a playing surface, said basketball goal assembly comprising:

a rigid support pole having a goal side and an opposing back side;

a goal support structure disposed in relation to said support pole at said goal side, said goal support structure being deformable into a plurality of configurations wherein at each configuration the basketball goal is disposed at a different height above said playing surface;

an extension arm having a first end connected to said goal support structure and a second end connected to said back side of said support pole such that movement of said extension arm selectively deforms the goal support structure;

a stabilizing arm having a first end pivotally attached to said rigid support and a second end pivotally attached to said second end of said extension arm; and an adjustable compression mechanism comprising a first adjustment member connected to said extension arm at a first point of attachment and a second adjustment member connected to said support pole at a second point of attachment, said second point of attachment positionable above said first point of attachment, wherein said second adjustment member is configured to cooperate with said first adjustment member thereby permitting movement of the first adjustment member relative to said second adjustment member to selectively dispose said goal support structure into said plurality of configurations in relation to said playing surface.

16. A basketball goal assembly as defined in claim 15, wherein said first adjustment member comprises a threaded portion configured for threaded engagement with said second adjustment member.

17. A basketball goal assembly as defined in claim 15, further comprising a handle operably attached to said first adjustment member to facilitate movement of the first adjustment member relative to said second adjustment member.

18. A basketball goal assembly as defined in claim 15, further comprising a support base having a receiving aperture for receiving and retaining said support pole in a substantially upright position relative to said playing surface and configured to receive and selectively retain a ballast material.

* * * * *